US008342074B1

(12) United States Patent
Sane et al.

(10) Patent No.: US 8,342,074 B1
(45) Date of Patent: Jan. 1, 2013

(54) VISION SYSTEM

(75) Inventors: Ajit Yeshwant Sane, Essex Junction, VT (US); William E. Howard, Richmond, VT (US); Russell J. Mitchell, Saint Albans, VT (US); Paul A. Palmer, Mt. Pleasant, SC (US)

(73) Assignee: General Dynamics Armament and Technical Products, Inc., Charlotte, NC (US)

( * ) Notice: Subject to any disclaimer, the term of this patent is extended or adjusted under 35 U.S.C. 154(b) by 0 days.

(21) Appl. No.: 13/112,590

(22) Filed: May 20, 2011

Related U.S. Application Data

(60) Provisional application No. 61/346,716, filed on May 20, 2010.

(51) Int. Cl.
*F41H 5/26* (2006.01)

(52) U.S. Cl. ..... 89/36.14

(58) Field of Classification Search ..... 89/36.01, 89/36.04, 36.07, 36.08, 36.09, 36.11, 36.12, 89/36.13, 36.14
See application file for complete search history.

(56) References Cited

U.S. PATENT DOCUMENTS

| | | | | |
|---|---|---|---|---|
| 4,005,662 | A * | 2/1977 | Kohn et al. | 109/16 |
| 5,452,641 | A * | 9/1995 | Kariya | 89/36.14 |
| 7,225,718 | B1 * | 6/2007 | Grove et al. | 89/36.09 |
| 2009/0044694 | A1 * | 2/2009 | Allor et al. | 89/36.08 |
| 2009/0120274 | A1 * | 5/2009 | Schneider et al. | 89/36.08 |

* cited by examiner

*Primary Examiner* — Michael Carone
*Assistant Examiner* — John D Cooper
(74) *Attorney, Agent, or Firm* — Hunton & Williams LLP

(57) ABSTRACT

A system and method for visual awareness that replaces transparent armor with opaque armor while still providing for clear vision for the occupants of a vehicle. The system and method may include a number of components with at least one partially mirrored surface. A component may have an armored base and a reflective surface or other means for directing light. The components may be arranged in a manner to block the direct path of a threat while still allowing a given optical path through the system.

26 Claims, 13 Drawing Sheets

| Type | Window Opening (inches) | Visible Opening (inches) | Visible Blocked Ratio | Depth Required (inches) | Cross Sect Area ($in^2$) |
|---|---|---|---|---|---|
| 2.5 thick stacked Vee | 18 inches | 7.16 inches | 0.40 | 16.6 | 104.7 |
| | | | | | |
| 1.5 thick stacked Vee | 18 inches | 9.2 inches | 0.51 | 14.0 | 66.1 |
| | | | | | |
| 1.5 thick flipped Vee | 18 inches | 10 | 0.55 | 9.0 | 63.5 |
| | | | | | |
| Multi reflect 1 1.5 thick | 18 inches | 3.5 | .19 | 10.0 | 64.2 |
| | | | | | |
| Side Stack 1.5 thick | 18 inches | 6 | .33 | 10.7 | 49.1 |

Figure 13

VISION SYSTEM

CROSS REFERENCE TO RELATED APPLICATIONS

This application claims the benefit of priority under 35 U.S.C. §119(e) of U.S. Provisional Application Ser. No. 61/346,716, filed May 20, 2010, the content of which is relied upon and incorporated herein by reference in its entirety.

TECHNICAL FIELD

The present embodiments relate generally to a visual awareness system, and, more particularly, to a vehicle having a visual awareness system with protective features.

BACKGROUND

Transparent armor is a material or system of materials designed to be optically transparent yet protective against fragmentation or ballistic impacts. This class of material is used in diverse applications from non-combat to combat usages, but is most often used in ground vehicles, including resupply vehicles, trucks, High Mobility Multipurpose Wheeled Vehicles, armored personnel carriers, tanks, personnel transport vehicles, reconnaissance vehicles, and other modes of ground transportation. Modern transparent armor is often made of layered plastic and glass or ceramic separated by polymer interlayers. The armor used in these applications must stand up to multiple projectile strikes while still being large enough to afford the driver and other occupants an adequate range of vision.

There are countless drawbacks to the use of transparent armor in ground vehicles. The armored windshields and windows are most often made from plastic and glass, two materials that add tremendously to the already parasitic weight of a vehicle's armor system. The added mass is often so great that the drivetrain and suspension require substantial modification and upgrades in order to uphold hauling and performance requirements. Materials comprising transparent armor must also must be formed extremely thick to provide proper protection, but increases in armor thickness results in a loss of interior cabin volume, thus restricting the occupants' movement. The increased thickness also reduces optical clarity, meaning that as the transparent armor is designed to improve protection against incoming projectiles, there is a commensurate drop in visual acuity, serving to reduce operational safety.

Although advancements in transparent armor have slowly progressed and attempted to make use of transparent ceramics and various other polymers, there are grave concerns among manufacturers and users about the compatibility of future transparent armor systems with infrared and night-vision goggles while still providing protection against future threats such as advanced laser technology, so there exists a need for a system to provide vision to the occupants of a vehicle while still retaining a high level of protection.

One attempted solution to the weaknesses presented by the use of transparent armor has been the reduction of the size of the windshield or window where transparent armor is used. Smaller windows are structurally stronger and are thus more protective, but using a smaller window reduces the driver's line of sight, thus reducing operational safety despite enhanced structural protection.

Perhaps the most significant drawback of the windshields and windows constructed from transparent armor is that even after being thickened, reinforced, and treated, they still offer only limited protection to the occupants of a vehicle. Furthermore, a single shot can induce a large zone of opacity thereby significantly reducing or even eliminating visual awareness. Many transparent armor systems would fail upon a direct hit from a .50 caliber round unless modified even further to withstand impacts. When explosively formed projectiles ("EFPs") are used to attack these vulnerable areas on vehicles, the results can be fatal. Because of the obvious vulnerabilities of transparent armor, attackers frequently target the areas of a vehicle where transparent armor is used, often having disastrous consequences.

Notwithstanding the various vision systems currently in existence, there exists a need for a highly protective vision system that does not add a significant amount of weight or otherwise serve as a tactical disadvantage.

SUMMARY OF THE INVENTION

The present disclosure provides a number of exemplary embodiments that may be used collectively, in various combinations, or alone. The following summary provides examples of such inventions, and does not limit the invention as claimed in any way.

In various exemplary embodiments, the invention is a visual awareness system comprising at least one top component having an armored body and at least one reflective surface, at least one middle component having an armored body and at least one reflective surface, at least one bottom component having an armored body and at least one reflective surface, and wherein the components are arranged in a manner forming at least one optical path.

BRIEF DESCRIPTION OF THE DRAWINGS

The embodiments set forth in the drawings are illustrative and exemplary in nature and not intended to limit the subject matter defined by the claims.

The invention, both as to its structure and operation together with the additional objects and advantages thereof are best understood through the following description of exemplary embodiments of the present invention when read in conjunction with the accompanying drawings, wherein like structure is indicated with like reference numerals and in which:

FIG. 13 shows a table quantitatively comparing the various different embodiments shown in FIGS. 1-12.

DETAILED DESCRIPTION OF THE INVENTION

Figure 1:
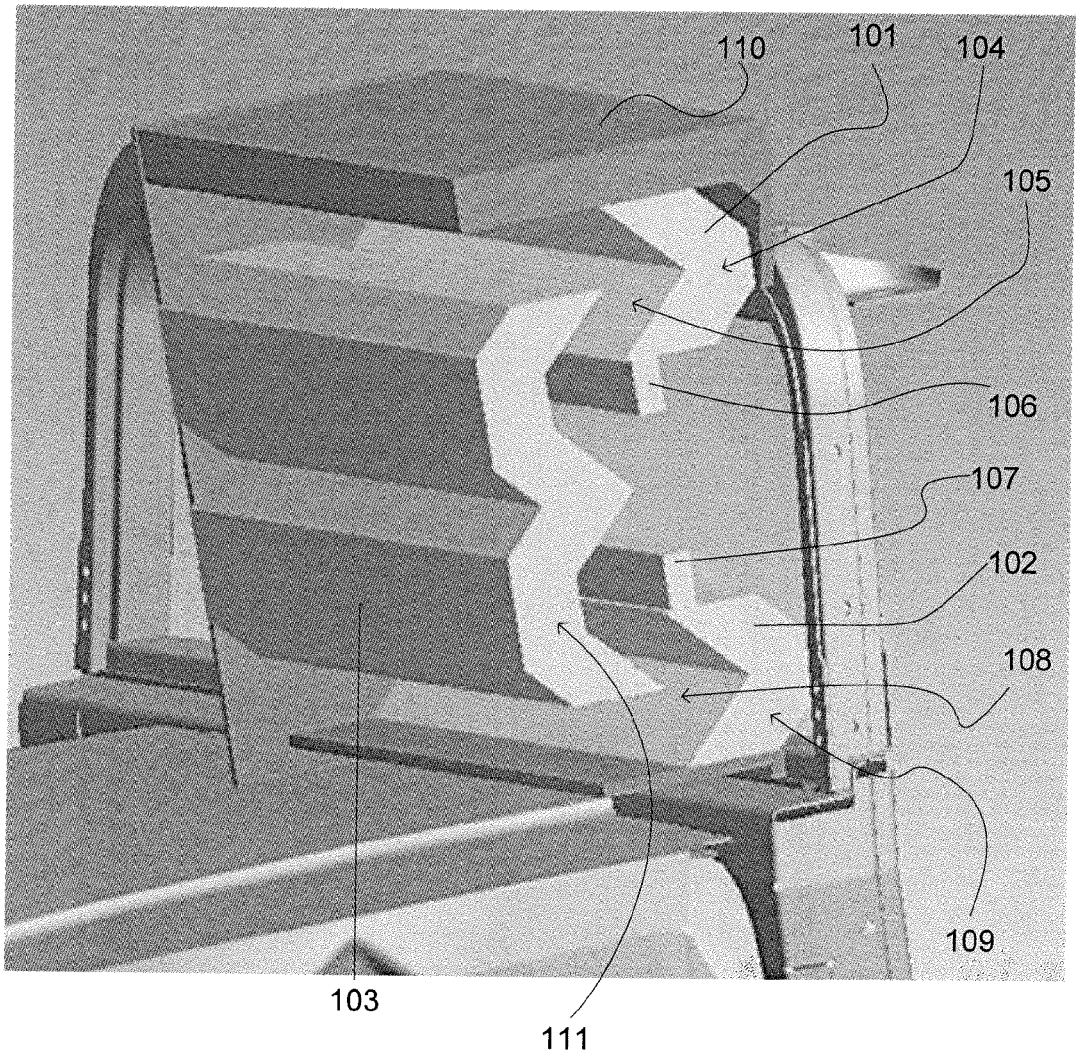
FIG. 1 depicts an exemplary vision system with top, middle, and bottom components, mounted on a frame.

The following description conveys an understanding of embodiments that generally relate to vehicles, such as armored vehicles, and more particularly to vehicles having a visual-awareness system that may reduce the need for transparent armor. Numerous exemplary embodiments of vehicles having these visual awareness features are described below. Armored vehicles, and other wheeled and non-wheeled vehicles are described by the exemplary embodiments with these features, but the invention is not limited to only those embodiments. For example, exemplary embodiments may be used for any vehicle or other machine or device, including non-military vehicles, machines, devices, or even anti-riot gear.

The exemplary embodiments may be sized or shaped differently in any suitable manner and may be adapted to add or remove components without deviating from the scope of this description. One possessing ordinary skill in the art will appreciate the use of the exemplary embodiments for purposes and benefits in alternative forms and industries, depending upon specific design needs and other considerations.

Terminology used in this description is for describing particular embodiments only and is not intended to limit the scope of an exemplary embodiment. As used throughout this disclosure, the singular forms "a," "an," and "the" include the plural, unless the context clearly dictates otherwise. Thus, for example, a reference to "a path" may encompass a plurality of paths, or other equivalents or variations known to those skilled in the art. Furthermore, permissive language (e.g., "may") is used for describing some embodiments or features, such use does not suggest that embodiments or features described using other language (e.g., "is," "are") are required. Unless defined otherwise, all terms have the same commonly understood meaning that one of ordinary skill in the art to which this invention belongs would expect them to have.

With regard to the exemplary embodiments of the visual awareness system, any part that fastens, inserts, attaches, or connects any component to or from another feature or vehicle is not limited to any particular type and is instead intended to encompass all known possibilities. Unless otherwise specifically disclosed, materials for making components of the present invention may be selected from appropriate materials, such as metal, metal alloys, ballistic metals, ballistic metal alloys, natural or manmade fibers, composites, vinyl, plastics, silicone, rubber, and so on. Any and all appropriate manufacturing or production methods, such as casting, pressing, extruding, molding, machining, may be used to construct the exemplary embodiments or their components.

When describing exemplary embodiments, any reference to relative position (front and back or rear, top and bottom, right and left, upper and lower, and so on) is intended to conveniently describe those embodiments only. Positional and spatial references do not limit the exemplary embodiments or its components to any specific position or orientation.

The present disclosure provides a number of exemplary embodiments that may be used collectively, in various combinations, or alone. The following summary provides examples of such inventions, and does not limit the invention as claimed in any way.

The present invention relates to a visual awareness system that replaces transparent armor with opaque armor while still providing for clear vision for the occupants of a vehicle. A "visual awareness system" may be a panel that may be removably installed in a vehicle in place of a windshield.

In various exemplary embodiments, the system is composed by a number of components with at least one partially mirrored surface. A component will have an armored base and a reflective surface or other means for directing light. The components are arranged in a manner to block the direct path of a threat while still allowing a given optical path through the system. This serves to provide high degrees of both visibility and protection to the users of the system. "Armored" may be defined as generally able to withstand the impact of a projectile, explosion, or other impact in order to shield the user from some kinetic force. "Mirrored" may be defined as generally able to reflect light in a manner providing sufficient visual clarity.

Other uses and variations of the foregoing will be apparent to one of ordinary skill in the art. The present embodiments disclosed herein are generally designed to provide a visual awareness system for a vehicle, such as an armored vehicle, while still providing protective features.

Generally, the visual awareness system described herein relates to multiple components forming a optical path to provide binocular vision by folding the optical path around opaque armor to protect the occupants of a vehicle. The optical path is modified by using one or more mirrors, lenses, optical waveguides, prisms, or some combination of those to provide a viewing zone inside of the vehicle.

In one embodiment, a mirror might be used. Mirrors are often produced by applying a reflective coating to glass. Other suitable substrates might be used, including applying a reflective coating directly to the armor. The reflective coatings used in a mirror can be made from a variety of substances, such as silver, aluminum, or any other light-reflecting material. The mirror could be any shape depending on the light reflecting properties desired. For example, using a plane mirror may be desired to provide the truest view possible of the surroundings in some circumstances, while a convex mirror might be desired in other circumstances to provide the widest-angle view possible. Additionally, each surface might use a different types or shapes of mirror so as to achieve the desired view range without compromising view accuracy.

Other means of reflecting the light might be used. In one embodiment, a multi-layered polymeric film may be selected to reflect light. A metal-free application might reduce conductivity and corrosivity if so desired. An aluminum vapor-coated film with a weatherproof coating might achieve similar effects. Alternatively, there are numerous known reflective materials that could be used to allow the projectile to pass through without significantly reducing the reflecting area. In an exemplary embodiment, the reflecting surface area will be reduced by the cross-sectional area of the projectile and the flatness of the reflecting surface remain unaffected by impact; once the projectile has passed through the reflecting surface, it is defeated by the opaque armor without causing a blowback that could alter the flatness of the reflecting surface.

In another embodiment, a prism or series of prisms might be used alone or in conjunction with a reflective surface to achieve the desired result. In another embodiment, a prism might be used as a means for directing light. The properties of some prisms allow light to enter in one direction and exit in a different direction. Using a triangular prism to implement the optical phenomenon of total internal reflection might be preferable to a mirror or other reflective surface in some circumstances. In another embodiment, a pentaprism, Porro prism, Porro-Abbe prism, Abbe-Koenig prism, Schmidt-Pechan prism, Dove prism, dichroic prism, Amici roof prism, or any other type of prism or light-directing mechanism might be used as a means of directing light, either by itself or coupled with another means of directing light such as a mirror, another prism, an optical waveguide, or any other appropriate mechanism. In an exemplary embodiment, a projectile is allowed to traverse through the prism material without causing it to shatter. There are several polymers that have sufficient optical clarity but sufficiently low strength and high elongation to failure to serve as a prism material.

Any type of armor may be used in conjunction with the vision system. In some embodiments, a metallic armor may be used. As one example, rolled homogeneous armor made of steel does not shatter when faced with a hard, fast impact. Steel of this type is crafted by casting steel billets and rolling said billets into plates with the desired thickness. Forging then smoothes the grained structured of the steel, reducing imperfections that might negatively impact the protective capacity of the material. Aluminum, titanium, iron, depleted uranium, or various other known types of protective metals might also be used as an armor in the system.

The application is not limited to metallic armor. Various other known protective materials might be used in the system. In another embodiment, ultra high molecular weight polyethylene may be used. In another embodiment, ceramic or ceramic plates might be selected. Ceramic in particular is known for its high efficacy against high-explosive anti-tank (HEAT) weapons. One downside to the use of ceramic tiles is that ceramic tiles have low criterion for multiple-hit capability. In still another embodiment, composite armor might be selected. Composite armor is often made when two or more materials with differing chemical properties are layered together to form a single piece of armor. An armor similar to what is commonly referred to as "Chobham armour" is one example of a composite armor that might be used in an exemplary embodiment. This type of armor could be constructed of ceramic tiles encased in a metal matrix, bonded to a backing plate and several other layers with high elasticity. To mitigate the aforementioned multiple-hit weaknesses of ceramic tiles, the tiles are manufactured as small as practically possible. The tiles, which are often hexagonal or square, are then encased in the matrix either by attaching them with an epoxy resin or by heating the matrix and isostatically pushing the tile into the matrix. The matrix is then attached to a backing plate to provide reinforcement of the tiles and protect the matrix against vibrations. This backing plate then serves as an energy reflector, directing impact back into the ceramic tiles, this time with a wider dispersion. The integrity of the tiles could still be compromised by strong impacts, but are often compressed to reduced the risk of significant structural damage. An additional metal plate is often used to compress the tiles, resulting in the tiles themselves actually serving to reinforce that metal plate, which has the end result of forming a self-reinforcing structure. Further advancements in this type of armor have been made, including adding a third axis of compression and using a suspension material and/or metallic casting to reinforce the core. In addition to the listed types of armor, any other type of known protective material might be used in the system. As technology progresses, any type of advanced armor might be selected for use in the system. For example, the invention might be constructed using carbon nanotubes, boron carbide, silicon carbide, aluminum oxide, aluminum nitride, titanium boride, synthetic diamond composites, or any other suitable material.

Although such an embodiment is possible, the reflective surface and armored component need not be separate parts entirely. For example, the surface of the armor could be aluminized to provide reflectivity. Alternatively, the surface of the armor itself could be polished to the desired level of reflectivity.

In an exemplary embodiment of the invention, the components of the visual awareness system are arranged such that they prevent a projectile from taking a direct path through the system (from the outside of the vehicle to the inside of the vehicle), referred to as a "shot path", In this way, the system is able to provide sufficient vision to the occupants of a vehicle while still blocking the shot path, thus preventing injury to the occupants of a vehicle.

Figure 2:
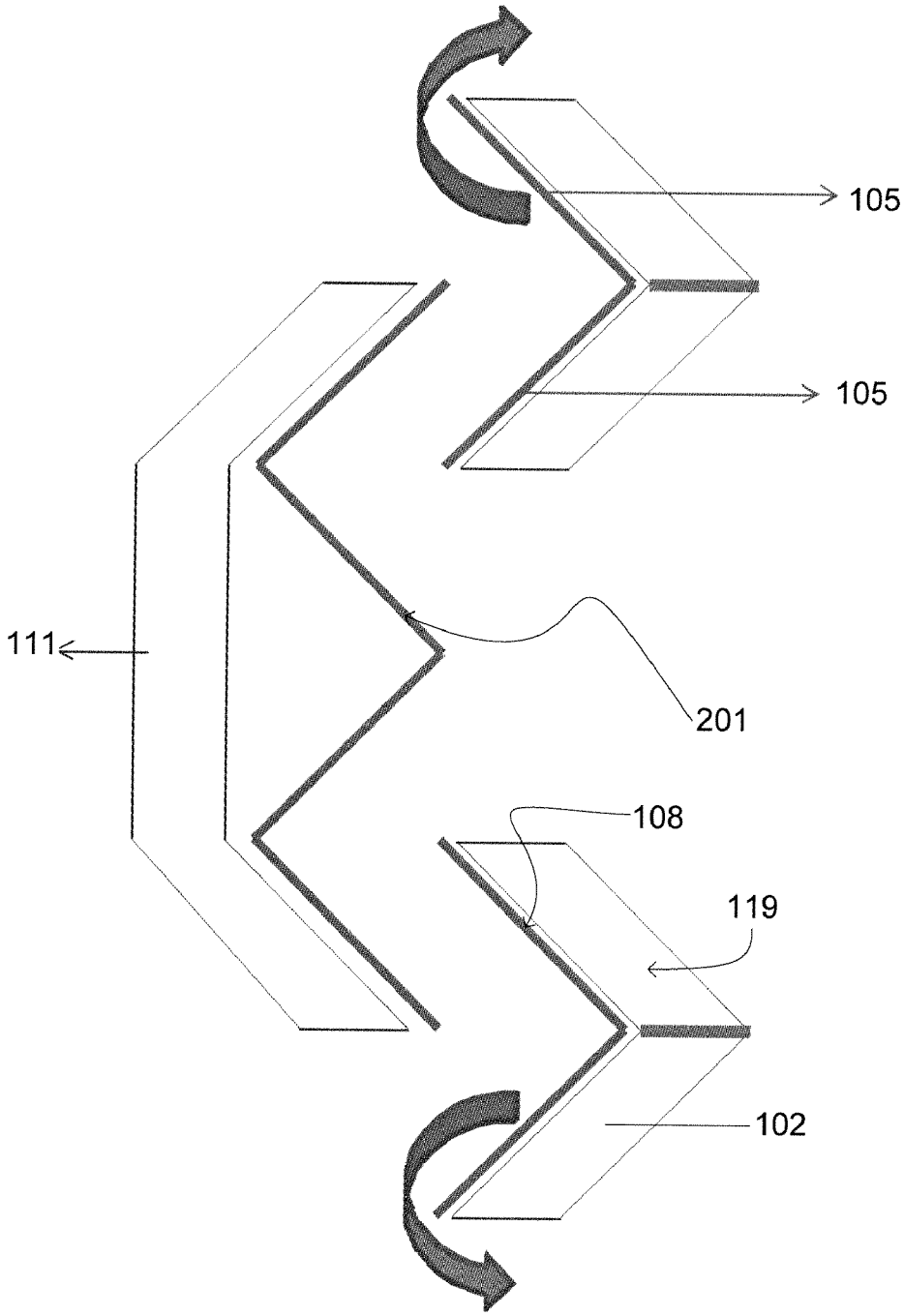
FIG. 2 depicts a cross-section view of the exemplary vision system shown in FIG. 1.
Figure 3:
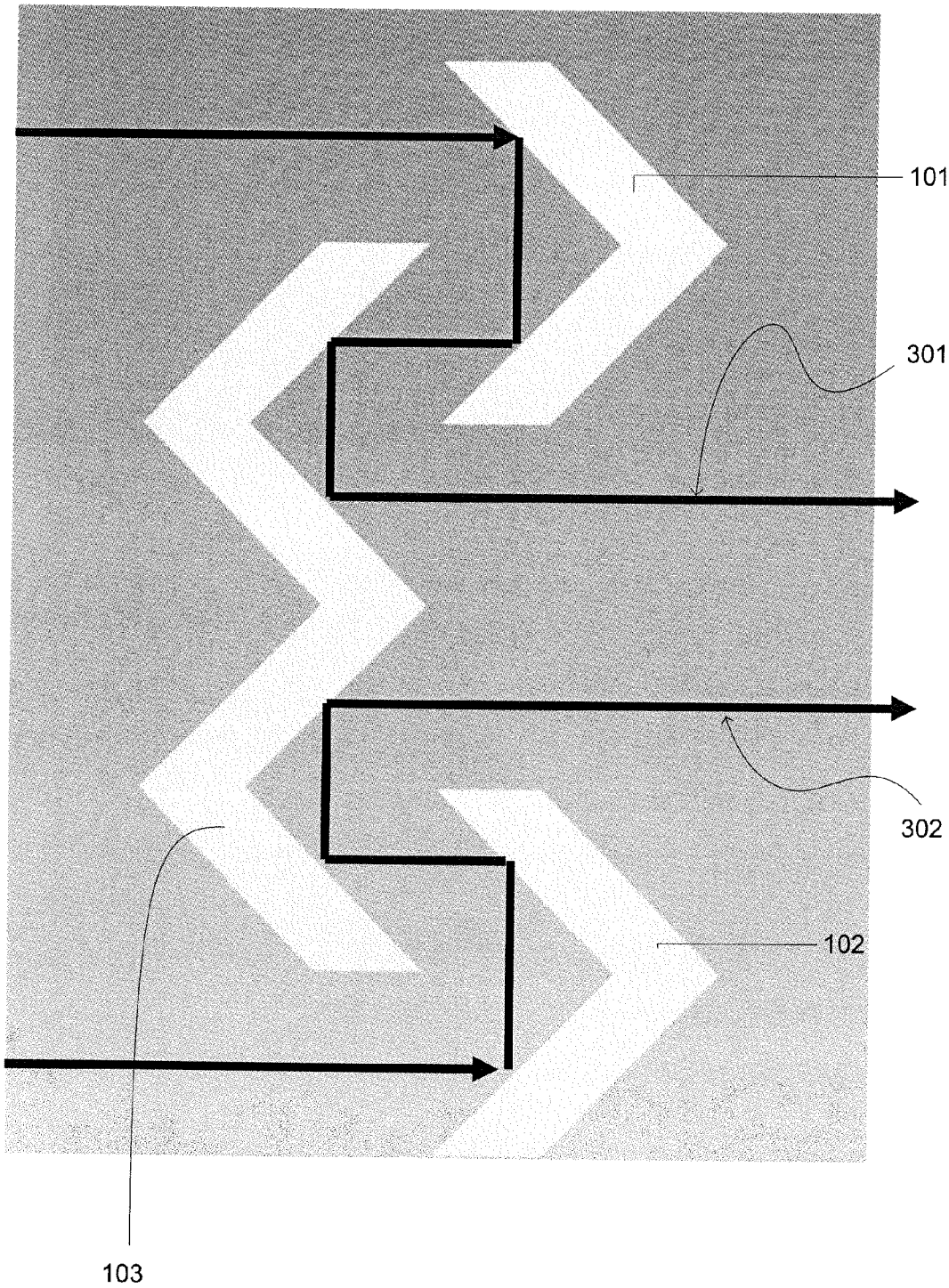
FIG. 3 depicts the optical path formed by the arrangement of the components in the exemplary embodiment of the vision system shown in FIG. 1.

Referring to FIGS. 1, 2, and 3, an exemplary embodiment of a visual awareness system for use in a vehicle is shown. In this embodiment, the visual awareness system may comprise a top component 101, a middle component 103, and a bottom component 102, which may form a top optical path 301 and a bottom optical path 302. As shown, the middle component 103 may generally be W-shaped, where the outward facing surface 111 is constructed from opaque armor and the inside facing surface 201 is constructed from a reflective material, such as a mirror. The top component 101 and the bottom component 102 may generally be V-shaped, where the outward facing surface of the top component 105 and the outward facing surface of the bottom component 108 are each constructed from a reflective material, such as a mirror. Additionally, the top component 101 has an armored body 104, and the bottom component 102 has an armored body 109. When assembled, the middle component 103 may overlap the bottom portion of the top component 101 and the top portion of the bottom component 102, thereby creating a top optical path 301 and a bottom optical path 302 for light to reflect into the vehicle, as shown in FIG. 3.

In the embodiment shown in FIGS. 1,2, and 3, light enters the vision system at two points. Light entering the top portion of the system first reflects off the top portion of the reflective surface 105 of the top component 101, then reflects off the bottom portion of the reflective surface 105 of the top component 101. The light is then reflected toward the middle component 111, first reflecting off the topmost portion of the reflective surface 201 of the middle component 103, then reflected to the next lower portion of the reflective surface 201 of the middle component 103, which in turn reflects the light out the other end of the vision system. This forms a top optical path 301, originating outside the system, traveling through the system, and emerging from the other side of the system.

Light entering the bottom portion of the system first reflects off the bottom portion of the reflective surface 108 of the bottom component 102, then reflects off the top portion of the reflective surface 108 of bottom component 102. The light is then reflected toward the middle component 111, first reflecting off the bottommost portion of the reflective surface 201 of the middle component 103, then reflected to the next higher portion of the reflective surface 201 of the middle component 103, which in turn reflects the light out the other end of the vision system. This forms a bottom optical path 302, originating outside the system, traveling through the system, and emerging from the other side of the system.

In an exemplary embodiment, the vision path may be split in two to provide a view from top and from bottom of the vision component such as window or windshield. In the case of a window, the top and the bottom mirror can be made to swivel about one or more axes. Swiveling a component changes the angle of incidence, thus allowing the optical path to change dynamically depending on the level of rotation of the component. In an exemplary embodiment, a top component and a bottom component might be made to swivel around their horizontal axes to provide a full top-to-bottom view of the surroundings. In another embodiment, a top and bottom component might be made to swivel around their vertical axes to provide almost 180 degree view of the surroundings. This may advantageously allow for additional protection without obstructing the optical path (i.e., there are no shot lines that are not intercepted by armor). In another exemplary embodiment, each component might be made to swivel on multiple axes, thus maximizing the possible viewable area and potentially even allowing a greater freedom of vision than that allowed by transparent armor. In one exemplary embodiment, a component might have a handle or otherwise equipped to facilitate manual adjustment of the component's angle. In another exemplary embodiment, a component might have a motor, pneumatic pressure system, or other means for automated movement to allow an occupant to change the angle of the component without physically interacting with the component itself. In another exemplary embodiment, a component might be automatically adjusted based on the occupant's gaze or head position, in response to verbal or non-verbal commands from an occupant, or other means of control.

Referring back to FIG. 1, in which the system is deployed as a windshield, a baffle 106 may be added to reduce the mixing of images from multiple sources. Moreover, the system may be enclosed in a lightweight box or a housing 110 that can be easily attached to the vehicle frame. In an exemplary embodiment, the lightweight box or housing 110 may be hingedly connected to the vehicle. In this exemplary embodiment, an occupant may be able to open and close the lightweight box or housing 110. This configuration may serve several advantageous purposes. For example, providing a hingedly connected windshield will permit the operator of the vehicle to open the lightweight box or housing 110 during non-combat situations to provide increased visibility or airflow. Furthermore, the hinged connection may also provide the operator of the vehicle with an avenue of egress from the vehicle in the event of an emergency situation. It should be appreciated the foregoing example of a hinged connection is exemplary only, and that other exemplary configurations (e.g., sliding as opposed to hinging mechanism, etc. . . . ) may be deployed to achieve a similar result.

As mentioned above however, this visual awareness system may be used to replace transparent armor used in a windshield, window, overhead gunner's protection kit, or any place where transparent armor is on a vehicle.

Figure 4:
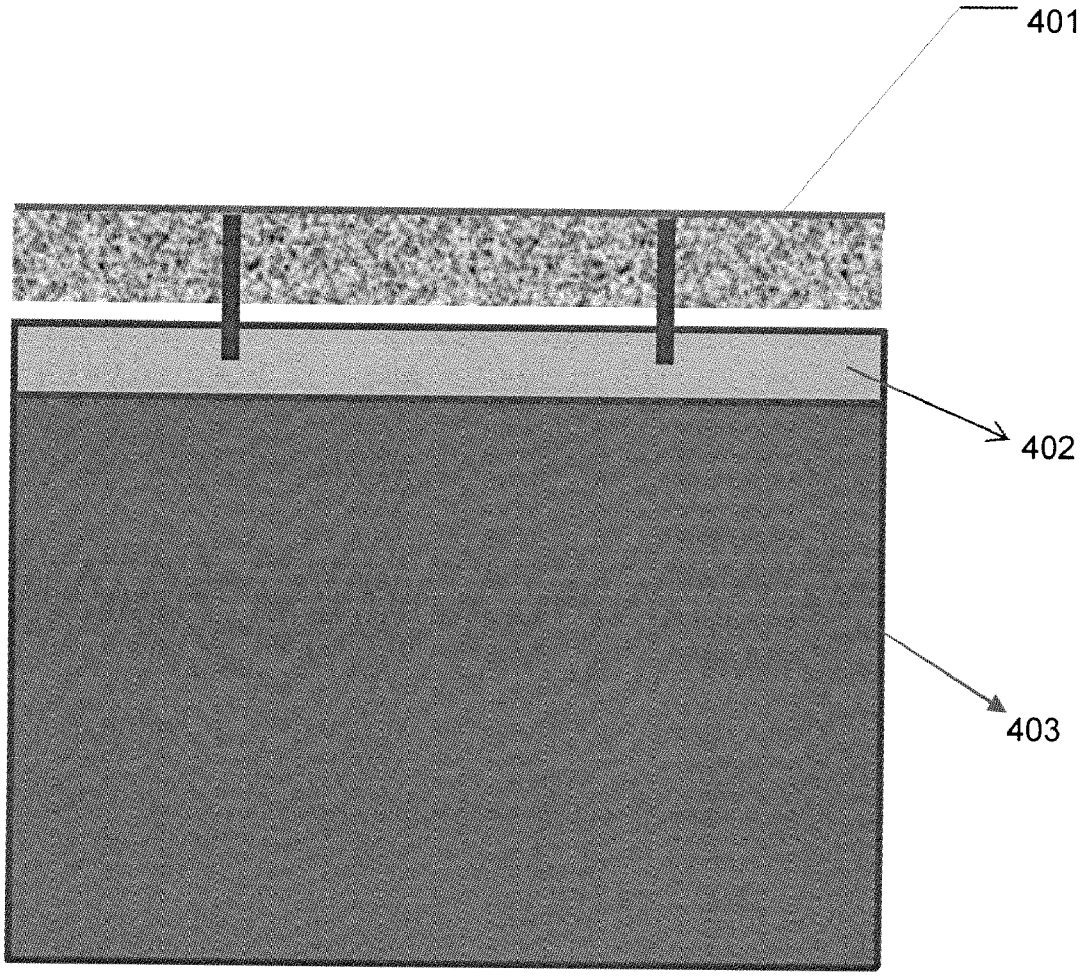
FIG. 4 depicts a cross-section of an exemplary component of the system, showing both the armored body and mirrored surface.

Referring to FIG. 4, a cross-section of a portion of the middle, top, or bottom portion is shown. In one embodiment, the reflective surface of the portion 401 is a mirror made out of thin stiff acrylic sheet that has been made reflective by aluminizing the surface (evaporating a thin film of aluminum) and passivating it either by controlled oxidation or by depositing a diamond like film to provide high reflectance as well as high scratch resistance. The mirror may be aluminum foam sandwiched between two aluminum sheets to create a stiff ultra-light weight mirror. Alternately, aluminum foam may be replaced by a carbon-carbon composite backing. In one embodiment, the reflective surface of the portion 401 may be anchored into the armor body 403 using an anchoring non-blowback layer 402. The non-blowback material serves to anchor the reflective surface to the rest of the system and/or to prevent a projectile from ricocheting or otherwise making contact with multiple points in the system. The non-blowback layer could be made out of a number of materials. In one embodiment, the non-blowback layer could be made out of a ballistic gel, a rubberized material, laminated polymer or glass, or a metal. In one exemplary embodiment, the non-blowback layer is made out of aluminum. In an exemplary embodiment, the non-blowback layer may be formed of a layer of steel in the range of 0.1" to 0.125" thick (e.g., MIL-STD-46100 BHN-500) backed by 1 psf of Dyneema (HB50) and 1" think rigid polymer (e.g. LAST-A-Foam by General Plastics or ELFoam by EllicottCo.). This layer is positioned adjacent to an armor body so that a projectile penetrating into the steal punches a hole in it, thereby forcing steel fragments inwards through Dyneema and foam. It should be appreciated that layers may be bolted together, laminated, or contained in a suitable frameworks that also includes other components of the vision system. Ejecta from armor is contained in the space provided by the foam and prevented from escaping the layer by Dyneema and the constraining steel cover. As a result, the reflecting surface is not damaged and visual awareness remains unaffected. It should be understood that this configuration may be utilized to absorb small caliber rounds such as AK47 rounds and fragments from Improvised Explosive Devices (LED's), often having kinetic energy less than 30000 joules. For more energetic fragments, increased space and thicker panels may be deployed. It should be appreciated that the precise make-up will depend on expected energetic fragment size, shape, weight, velocity, and spatial distribution.

Still referring to FIG. 4, the materials selected for use in the visual awareness system may mitigate the damage zone by a projectile or a fragment so that the system can absorb multiple hits without reducing visibility substantially. For example, the reflecting materials may allow the projectile to go through or allow the projectile to get buried in the underlying materials without significantly disrupting the reflecting surface. Such materials are commonly manufactured via lamination. In one possible embodiment, these materials could include a layered polycarbonate and/or glass material (commonly called "bullet-resistant glass") so as to allow a projectile to penetrate the outermost layer of the material, but not shatter the material. Using this type of material would impair visibility only in the approximate location the projectile struck the material, rather than rendering the entire surface of the material unusable for its intended purpose. In another potential embodiment, a thermoplastic could be used. For example, polymethyl methacrylate and polycarbonate are known as lightweight and shatter-resistant alternatives to glass. The use of such a thermoplastic for the reflective surface of a component would reduce the potential of loss of visibility due to projectile impact to the surface. In an alternative embodiment, the outer surface of the reflective material might be rubberized, allowing a projectile to pass directly through the material until a more protective surface is reached. In this way, the resulting visual disturbance would be narrowed only to the precise point of impact rather than affecting the visual acuity of the entire surface. In another embodiment, the reflective surface itself might be a thin, easily breakable film that would allow a projectile to easily tear through and pass into a non-blowback layer backing the film, again serving to minimize the affect of the impact on visual acuity.

In an exemplary embodiment, the components will be arranged such that light waves originating from the outside of the vehicle are reflected (or otherwise directed) through a non-direct path, eventually reaching the inside of the vehicle. By using a non-direct path, the occupants of the vehicle are protected from projectiles that might otherwise enter the vehicle. In one embodiment, each component may be at least partially covered with a reflective film. In that embodiment, ideally, each component would have a high capability for specular reflection, where the angle of incidence is equal to the angle of reflection and a ray of light from a single incoming direction is reflected in a single outgoing direction. Given the desired opening on the outside of the vehicle, the strength of protection needed, and the range of vision required for the application, the components can then be arranged in a manner that forms a sufficient light path while satisfying the given protective criteria. In this way, the occupants of the vehicle are afforded both a view of the surroundings and protection from threats.

The visual awareness system may further provide for greater protection because of its reduced weight. For example, a military vehicle may be designed for a particular objective that carries with it increased threats. These object-level threats may only be sufficiently met by the use of opaque armor instead of transparent armor. Thus, by reducing the amount or entirely eliminated transparent armor by replacing with the visual awareness system described herein, a military vehicle may be entirely equipped to protect against objective-level threats.

Stated differently, for a specific threat level, transparent armor may be less desirable because of its greater areal density as compared to opaque armor. As weight may be a critical factor in operational capability, excessive weight leads to shorter life, reduced mobility, and high fuel costs. Thus, in an exemplary embodiment, when a visual awareness system is used, the total component weight is no more than the weight of transparent armor based vision system for an equivalent visual awareness and protection level. Typically, a component such as window based on transparent armor may offer protection at a threshold level whereas the rest of the opaque armor offers protection at the objective level. Since the areal density of opaque armor even at the objective level is significantly lower than the areal density of the transparent armor, it is possible to design a vision system that provides the same visual awareness but offers the protection at the objective level.

In an exemplary embodiment, the constraint on solution is given by: $\langle Wo \rangle max \sim \{Ag*Wg-V\}/Ao$. Where $\langle Wo \rangle$ is the average value of opaque armor areal density required to defeat the threat at objective level, $\langle Wo \rangle$ max is its maximum value, Ao is the total area of the opaque armor in the solution, Ag is the area of transparent armor, Wg is the areal density of the transparent armor required to defeat the same threat (typically at the threshold level), V is the net contribution of non-armored components in the vision system such as mirrors, fixtures, etc.

Figure 5:
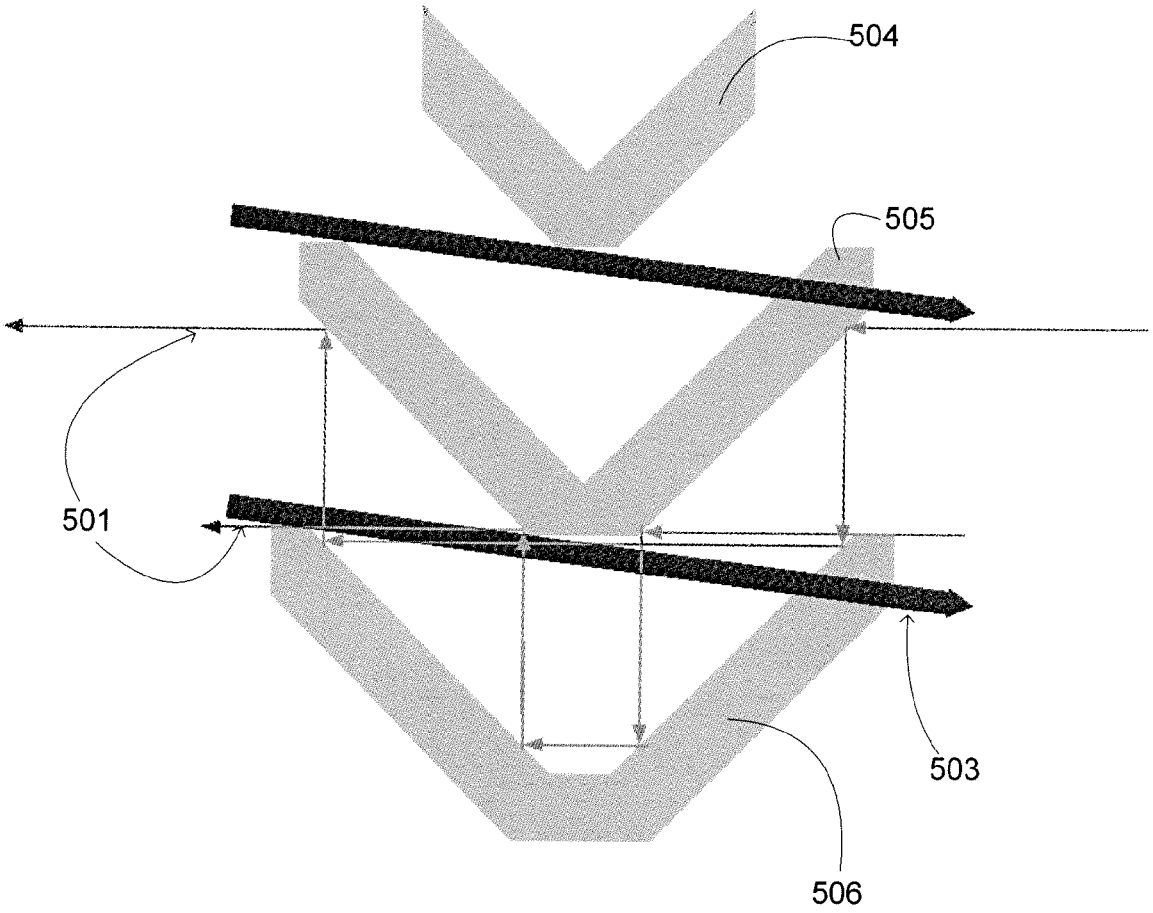
FIG. 5 depicts an exemplary embodiment of the vision system with three V-shaped components arranged in a stacked pattern.
Figure 6:
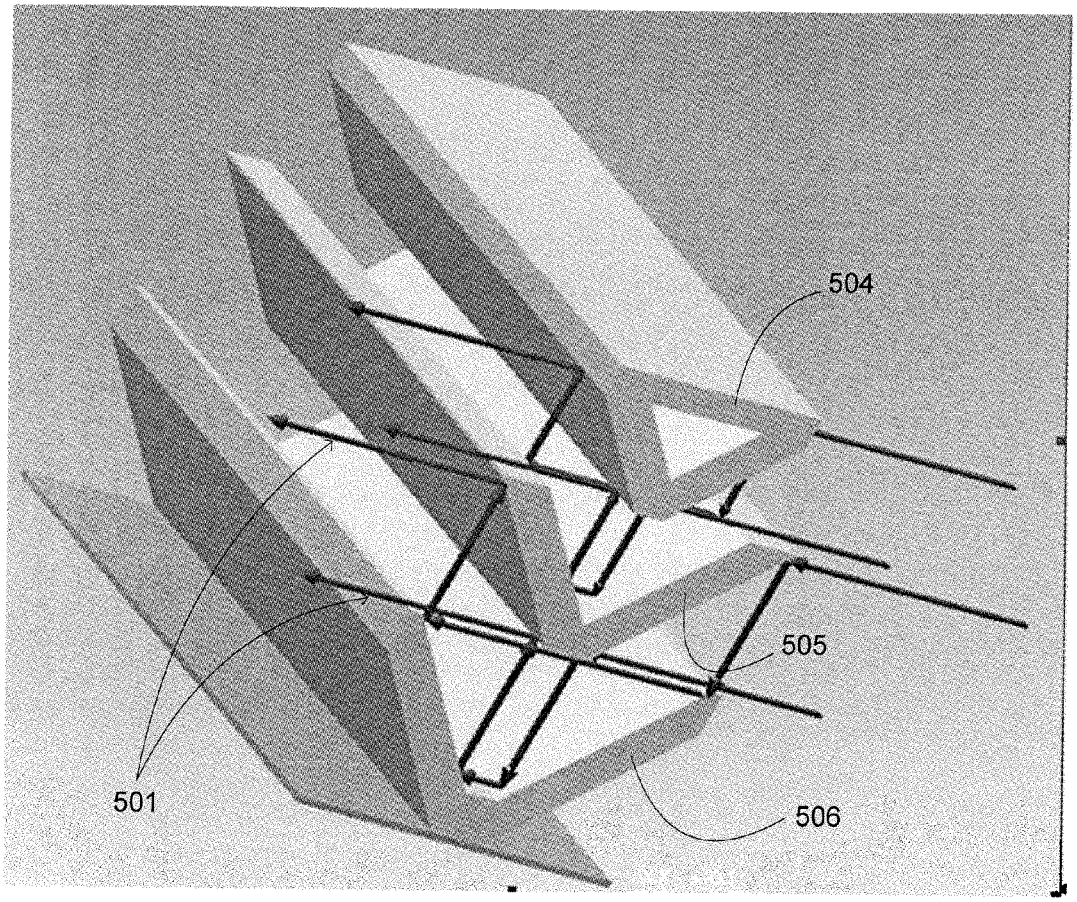
FIG. 6 shows a three-dimensional view of the exemplary embodiment shown in FIG. 5.
Figure 7:
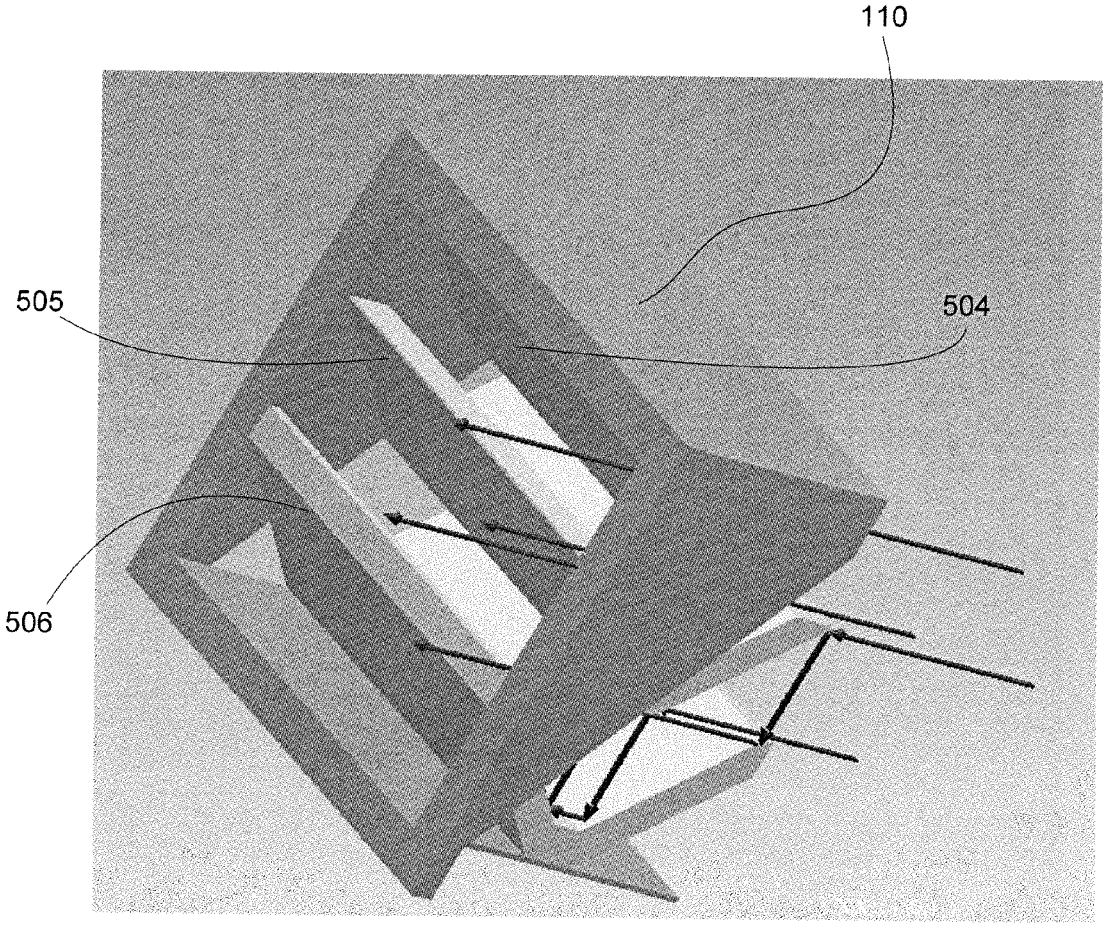
FIG. 7 shows the exemplary embodiment of FIGS. 5 and 6 mounted in an armored housing.
Figure 8:
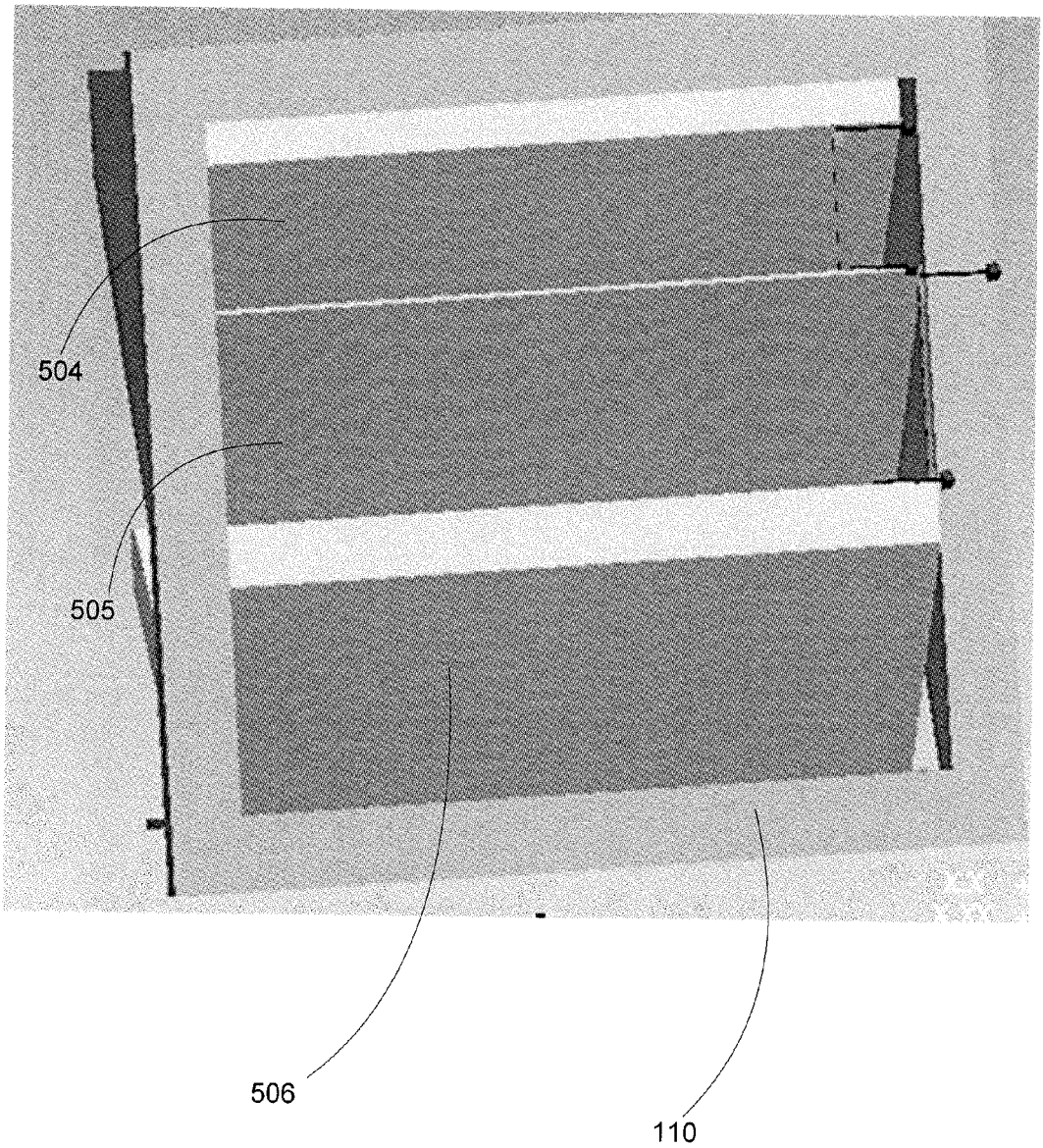
FIG. 8 shows a front view of the exemplary embodiment of FIGS. 5 and 6 mounted in an armored housing.

FIGS. 5 through 8 illustrate other exemplary embodiments of the invention. FIG. 5 shows a cross section of a top component 504, a middle component 505, and a bottom component 506. Each component has at least one reflective surface and an armored body. All three components in the pictured embodiment are V-shaped, arranged parallel to one another in a stacked formation. The reflective surface of each component allows the formation of multiple optical paths 501 through the apparatus. FIG. 5 further demonstrates a direct path 503 of a potential projectile blocked by the armored component. The direct path 503 has no angle of entry that allows a direct path to the opposite side of the vision system. This demonstrates the protective capability of the system. FIG. 6 shows the same embodiment in a three dimensional view. FIG. 7 shows this embodiment when contained within a housing 110. FIG. 8 shows a front view of the same embodiment. Additional components might be added to increase the total viewable area of the system or increase protection, and components might be removed when maximum viewable area is not the primary objective or fewer parts are necessary for any other reason. Each component may be made more or less thick to compensate for the level of protection required for a given application, and the components may be moved closer together, further apart, or arranged in a different manner so as to fulfill the needs of a given application. A "v-shaped" component is not necessary for the invention, it is only one possible design of the system; the invention might use a component of any shape as long as it would serve to provide an optical path through the system.

Figure 9:
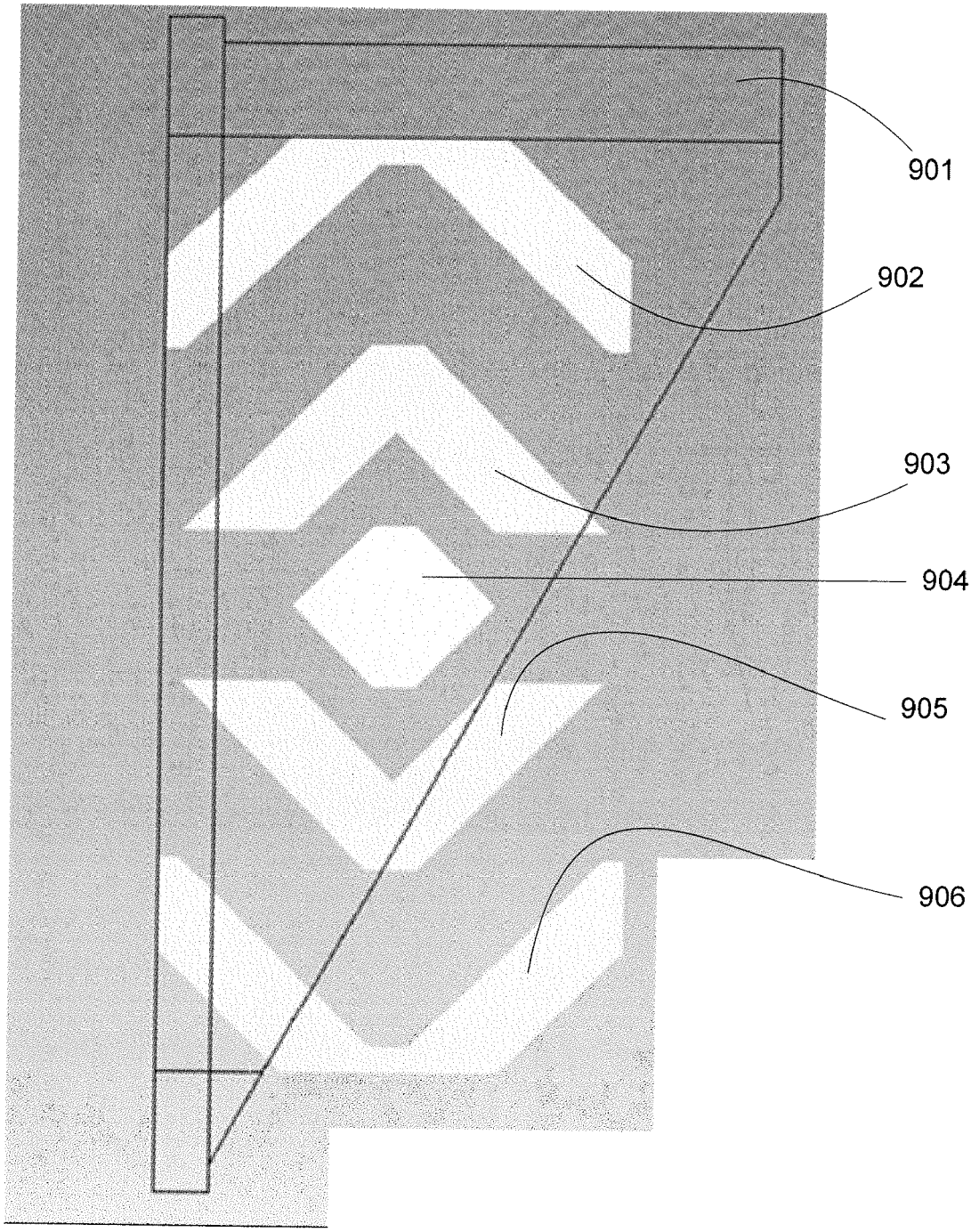
FIG. 9 depicts an exemplary embodiment of the vision system having two V-shaped top components, two V-shaped bottom components, and a hexagonal middle component.

Referring to FIG. 9, one possible embodiment of the system is shown. The view is a cross section showing a top V-shaped component 902, a top middle V-shaped component 903, a center middle component 904, a bottom middle V-shaped component 905, and a bottom V-shaped component 906. Each component has at least one reflective surface and an armored body. The top V-shaped component 902 and top middle V-shaped component 903 are arranged in one possible embodiment as stacked upside-down Vs, each having at least one surface parallel to at least one surface of the other and at least one surface parallel to the center middle component 904. Arranging the top V-shaped component 902 and top middle V-shaped component 903 in this manner forms multiple optical paths in the top half of the vision system. The bottom V-shaped component 906 and bottom middle V-shaped component 905 are arranged in one possible embodiment as stacked right-side-up Vs, each having at least one surface parallel to at least one surface of the other and at least one surface parallel to the center middle component 904. Arranging the bottom V-shaped component 906 and bottom middle V-shaped component 905 in this manner forms multiple optical paths in the bottom half of the vision system. Additional components might be added to increase the total viewable area of the system or increase protection, and components might be removed when maximum viewable area is not the primary objective or fewer parts are necessary for any other reason. Each component may be made more or less thick to compensate for the level of protection required for a given application, and the components may be moved closer together, further apart, or arranged in a different manner so as to fulfill the needs of a given application. The use of square, rectangle, or "v" shaped components are not necessary for the invention, it is only one possible design of the system; the invention might use a component of any shape as long as it would serve to provide an optical path through the system.

Figure 10:
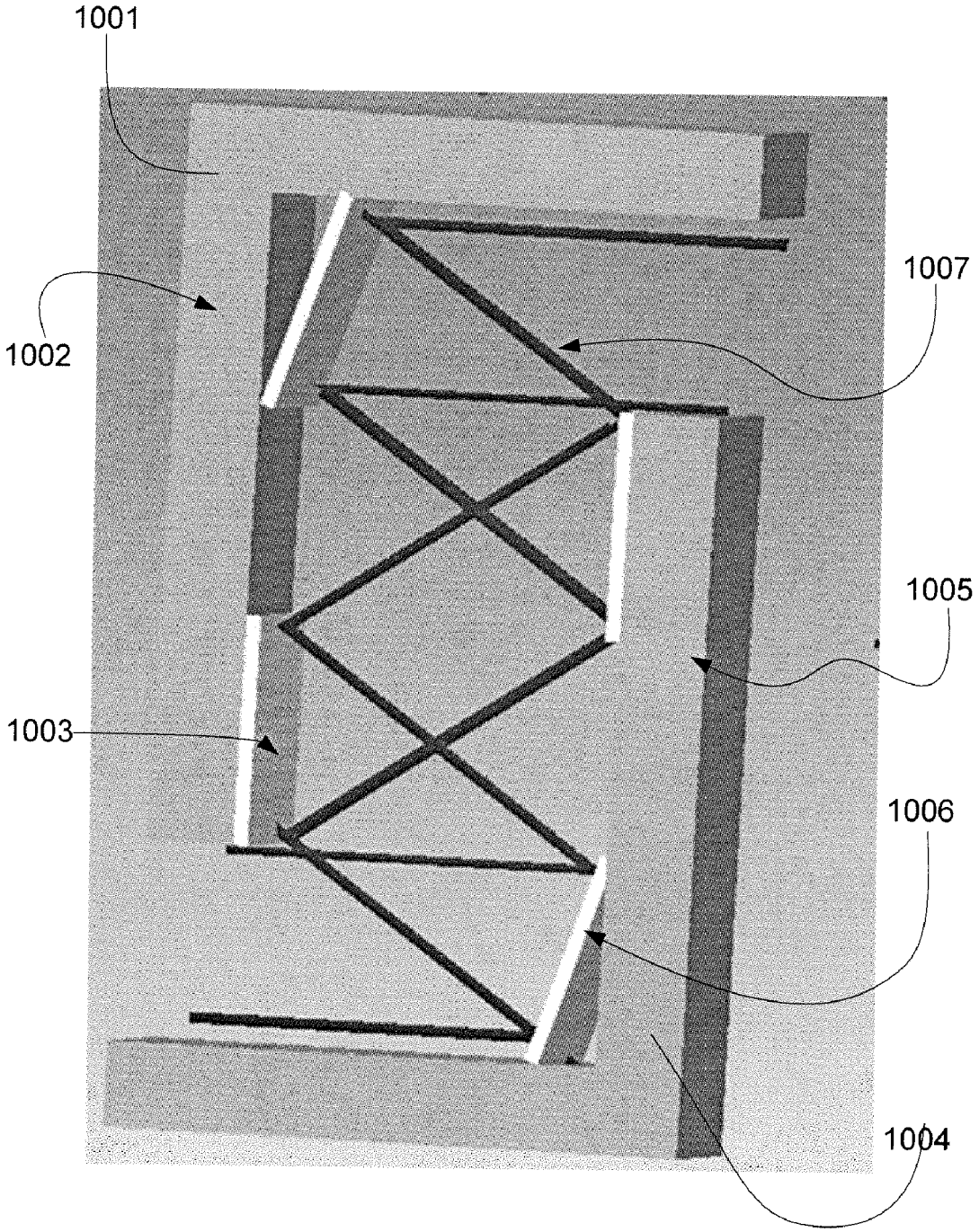
FIG. 10 depicts an exemplary embodiment of the vision system with only two components.

Referring to FIG. 10, another possible embodiment of the invention is shown. In this embodiment, there is both a top component 1001 and a bottom component 1004. The top component has an armored body 1002 and at least one mirrored surface 1003. The bottom component 1004 has an armored body 1005 and at least one mirrored surface 1006. The mirrored surface 1003 of the top component 1001 and the mirrored surface 1006 of the bottom component 1004 are arranged in a manner forming a optical path 1007 to allow light to travel through the device, the optical path 1007 originating on the outside of the system, traveling through the system, and emerging from the other opening of the system. Additional components might be added to increase the total viewable area of the system or increase protection, and components might be removed when maximum viewable area is not the primary objective or fewer parts are necessary for any other reason. Each component may be made more or less thick to compensate for the level of protection required for a given application, and the components may be moved closer together, further apart, or arranged in a different manner so as to fulfill the needs of a given application. "L-shaped" components are not necessary for the invention, it is only one possible design of the system; the invention might use a component of any shape as long as it would serve to provide an optical path through the system.

Figure 11:
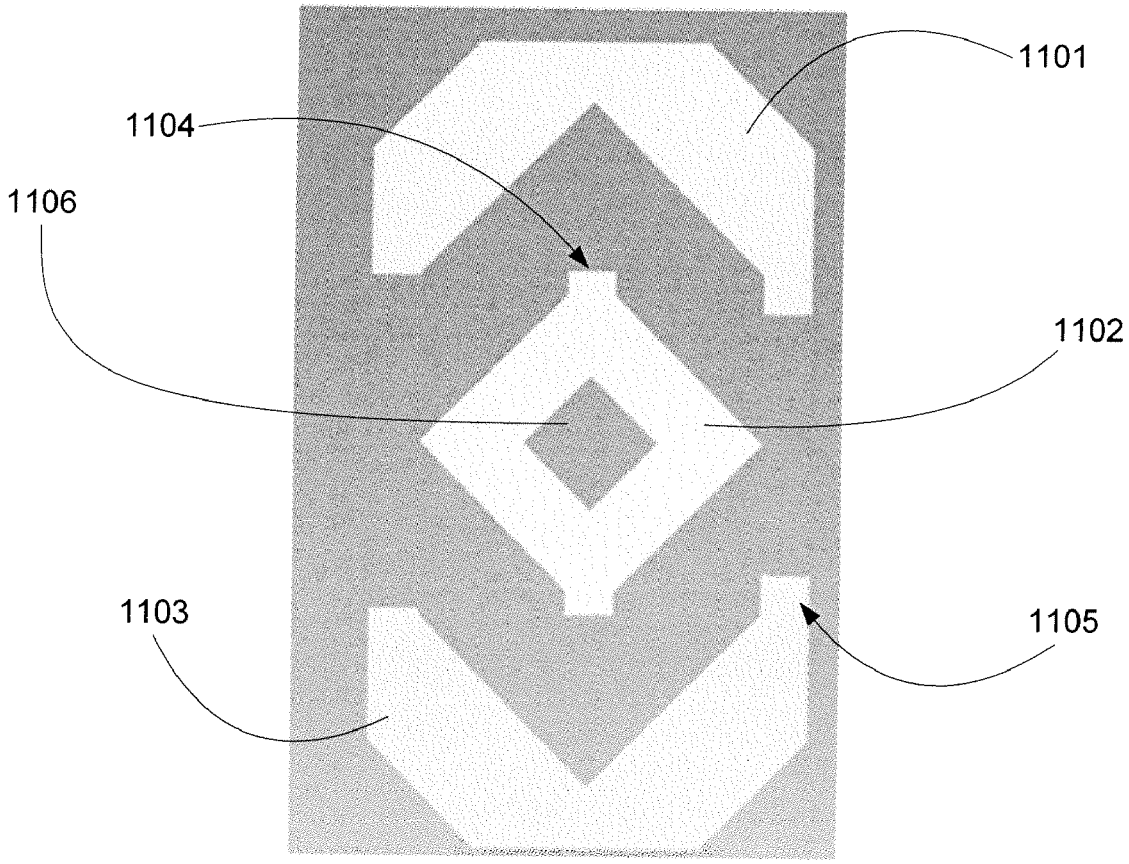
FIG. 11 depicts an exemplary embodiment of the vision system with top, middle, and bottom components, using baffles to reduce visual interference.
Figure 12:
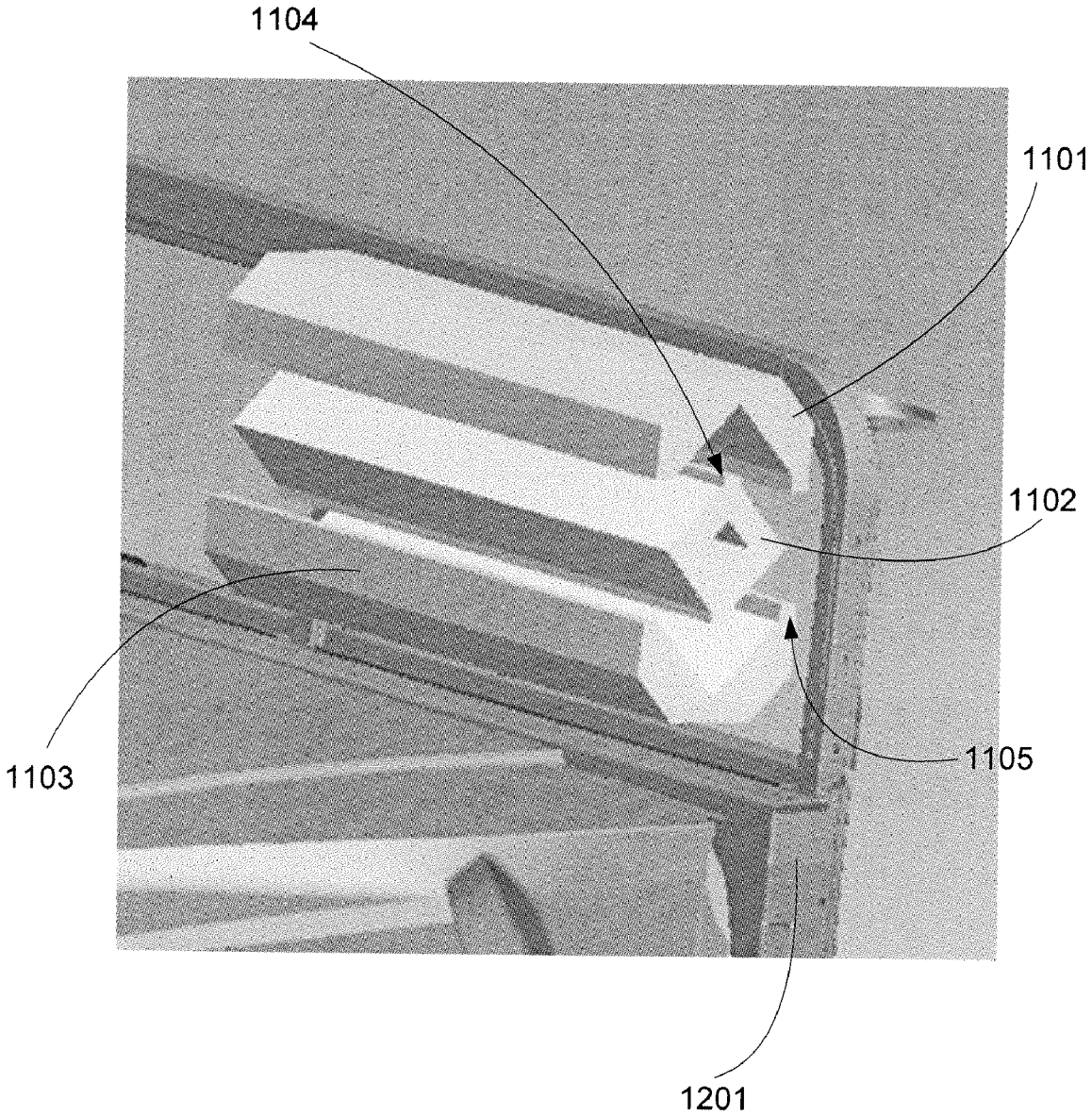
FIG. 12 shows a three-dimensional view of the exemplary embodiment shown in FIG. 11.

Referring to FIGS. 11 and 12, one possible embodiment is shown having a top component 1101, a middle component 1102 having an optional baffle 1104, and a bottom component 1103. The top and bottom components both optionally have at least one baffle 1105. The top/bottom baffle 1105 and middle component baffle 1104 serve to both increase protection against projectiles and to reduce visual interference. The middle component may optionally have a hollow center 1106 for weight reduction. In the pictured embodiment, both the top component 1101 and the bottom component 1103 have multiple surfaces parallel to multiple surfaces of the middle component 1102. In the pictured embodiment, the middle component 1106 is a squared shape with a baffle 1104, but in other embodiments may be rectangular, spherical, hexagonal, octagonal, or any other sufficient shape, either with or without the optional baffle. FIG. 11 shows the cross-section view of this embodiment while FIG. 12 shows a three dimensional view of this embodiment mounted onto a frame 1201. Additional components might be added to increase the total viewable area of the system or increase protection, and components might be removed when maximum viewable area is not the primary objective or fewer parts are necessary for any other reason. Each component may be made more or less thick to compensate for the level of protection required for a given application, and the components may be moved closer together, further apart, or arranged in a different manner so as to fulfill the needs of a given application. Square, diamond, rectangle, or "v" shaped components are not necessary for the invention, it is only one possible design of the system; the invention might use a component of any shape as long as it would serve to provide an optical path through the system.

The table reflected in FIG. 13 compares a number of exemplary possible solutions according to the present disclosure in terms of visible opening versus actual opening, visible/blocked area ratio, cross-sectional area in x-y plane (z direction being normal to the page) and minimum depth of the housing. This table is representative only and not meant to limit the number of possible solutions contemplated by this description in any way.

It should be appreciated that the foregoing embodiments are not intended to be limited solely to armored, combat, vehicles. The navigation system described herein can be configured for use in many other applications. By way of non-limiting example, the navigation system described herein can be used in conventional vehicles, vehicles used in mining and agriculture, as well as in planes and sea-based vehicles.

It will be readily understood by those persons skilled in the art that embodiments of the present inventions are susceptible to broad utility and application. Many embodiments and adaptations of the present inventions, other than those herein described, as well as many variations, modifications and equivalent arrangements, will be apparent from or reasonably suggested by the present invention and foregoing descriptions thereof, without departing from the substance or scope of the invention.

Accordingly, it is to be understood that this disclosure is only illustrative and exemplary and is made to provide an enabling disclosure. Accordingly, the foregoing disclosure is not intended to be construed to limit the present invention or otherwise to exclude any other such embodiments, adaptations, variations, modifications or equivalent arrangements.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combinations. It is therefore intended that the appended claims cover all such changes and modifications that are within the scope of the claimed subject matter.

The invention claimed is:

1. A visual awareness system comprising:

at least one top component having an armored body and at least one reflective surface;

at least one middle component having an armored body and at least one reflective surface;

at least one bottom component having an armored body and at least one reflective surface; and wherein the components are arranged in a manner forming at least one optical path through the system, each optical path comprising reflection of light off of at least three reflective surfaces.

2. The visual awareness system of claim 1, wherein each component has at least one surface parallel to at least one surface of at least one other component.

3. The visual awareness system of claim 1, wherein at least one component has at least one extended baffle for reducing visual interference.

4. The visual awareness system of claim 1, wherein the components are arranged in a manner preventing a direct line of sight through the system.

5. The visual awareness system of claim 1, wherein the components are arranged in a manner so as to prevent injury to a user.

6. The visual awareness system of claim 1, wherein each component further comprises an anchoring non-blowback layer disposed between the armored body and the at least one reflective surface.

7. The visual awareness system of claim 6, wherein the anchoring non-blowback layer comprises aluminum.

8. The visual awareness system of claim 1, wherein at least one component swivels on at least one axis.

9. The visual awareness system of claim 1, wherein the system is enclosed in a housing.

10. The visual awareness system of claim 9, wherein the system is mounted upon a vehicle frame.

11. The visual awareness system of claim 9, wherein the system is mounted on a turret.

12. The visual awareness system of claim 9, wherein the system is mounted on a protective shield.

13. The visual awareness system of claim 1, wherein the system is mounted upon a vehicle frame.

14. The visual awareness system of claim 1, the plurality of components comprising:

at least three V-shaped components;

at least one top component having an armored body and at least one reflective surface;

at least one middle component having an armored body and at least one reflective surface;

at least one bottom component having an armored body and at least one reflective surface;

the components arranged such that each component has at least one surface parallel to at least one surface of each other component.

15. The visual awareness system of claim 1, the plurality of components comprising:

at least four V-shaped components;

one center middle component;

with at least two of the V-shaped components arranged above the center middle component, with each of those components having at least one surface parallel to at least one surface of the center middle component; and with at least two of the V-shaped components arranged below the center middle component, with each of those components having at least one surface parallel to at least one surface of the center middle component.

16. The visual awareness system of claim 1, wherein at least one component is rotatable on at least one axis.

17. The visual awareness system of claim 1, wherein the system further comprises a non-blowback layer disposed between the armored body of a component and the reflective surface of a component.

18. The visual awareness system of claim 17, further comprising a means for directing light.

19. The visual awareness system of claim 1, further comprising a means for directing light.

20. A visual awareness system, comprising a plurality of components, each component having an armored body and a means for directing light along at least one optical path through the system, wherein each optical path comprises reflection of light off of at least three reflective surfaces.

21. A method for providing an external view to occupants of a vehicle, comprising:

providing a plurality of components, each component having an armored body and at least one reflective surface; and arranging the plurality of components so as to provide at least one optical path to view outside of the vehicle, wherein each optical path comprises reflection of light off of at least three reflective surfaces.

22. The method of claim 21, further comprising arranging the plurality of components so as to block any direct projectile path through the plurality of components.

23. The method of claim 21, wherein the plurality of components comprises at least 3 components.

24. The method of claim 21, wherein the plurality of components includes at least one "v-shaped" component.

25. The method of claim 21, further comprising providing a means of swiveling at least one component.

26. A visual awareness system, comprising a plurality of components, wherein:

each component has an armored body and at least one reflective surface;

the components are arranged in a manner forming at least one optical path through the system, each optical path comprising reflection of light off of at least three reflective surfaces;

the components are arranged in a manner blocking a shot path through the system; and one of the plurality of components is W-shaped and reflects light received from at least two other components of the plurality of components.

* * * * *